US007861858B2

(12) United States Patent
Wang

(10) Patent No.: US 7,861,858 B2
(45) Date of Patent: Jan. 4, 2011

(54) HOLDING DEVICE FOR USE IN A BATHROOM

(75) Inventor: Long-Sheh Wang, Chia Yi (TW)

(73) Assignee: Chntuo Industrial Co., Ltd., Chia Yi (TW)

( * ) Notice: Subject to any disclaimer, the term of this patent is extended or adjusted under 35 U.S.C. 154(b) by 0 days.

(21) Appl. No.: 12/071,725

(22) Filed: Feb. 26, 2008

(65) Prior Publication Data

US 2009/0211926 A1 Aug. 27, 2009

(51) Int. Cl.
*A45C 11/26* (2006.01)
*A45D 44/18* (2006.01)
*B65D 83/10* (2006.01)

(52) U.S. Cl. ..... 206/349; 206/15.3; 206/361

(58) Field of Classification Search ..... 206/581, 206/361, 349, 15.3, 15.2, 261; 211/65, 194, 211/188, 126.11, 126.12, 49.1; 15/257.01, 15/184, 160, 104.2, 104.92; 34/42; 312/206; 134/42

See application file for complete search history.

(56) References Cited

U.S. PATENT DOCUMENTS 4,008,933 A * 2/1977 Wanek ..... 312/206
4,033,650 A * 7/1977 Alissandratos ..... 312/206
4,415,211 A * 11/1983 Alissandratos ..... 312/206
D276,291 S * 11/1984 Boroch ..... D6/551
5,307,930 A * 5/1994 Wilk et al. ..... 206/349
5,984,100 A * 11/1999 Ramsey et al. ..... 206/581
D419,019 S * 1/2000 Shafik ..... D6/551
6,109,429 A * 8/2000 Cunningham et al. ..... 206/15.2
6,446,792 B1 * 9/2002 Kaniaris, Jr. ..... 206/15.3
6,647,567 B1 * 11/2003 Baldwin et al. ..... 4/661
D500,223 S * 12/2004 Libman et al. ..... D6/551
7,185,759 B2 * 3/2007 Rich ..... 206/349
7,328,793 B2 * 2/2008 Leaphart et al. ..... 206/349
D574,116 S * 7/2008 Yang et al. ..... D32/14
2004/0149608 A1 * 8/2004 Laux et al. ..... 206/349
2008/0197030 A1 * 8/2008 Wang ..... 206/216
2009/0000967 A1 * 1/2009 Shafik ..... 206/216

* cited by examiner

*Primary Examiner*—Ehud Gartenberg
*Assistant Examiner*—Kaushikkumar Desai
(74) *Attorney, Agent, or Firm*—Rosenberg, Klein & Lee

(57) ABSTRACT

A bathroom tool holding device includes a hollow body with an opening, a bearing member installed on the body to hold a toilet cleaning brush, a bottom cover joined to a bottom of the body, and a lid with a base; the bottom cover has a middle cavity, in which a pivotal shaft component is inserted; the lid is held in the body, and can be rotated to a closed position to shut the opening of the body at a curved covering half part thereof; the lid can be rotated to an open position so that a plunger can be placed in and taken out of the body; the base is pivoted on the pivotal shaft component for smooth rotation of the lid; the base is biased to come into close touch with the body with an elastic element, and in turn there is no aperture in between.

2 Claims, 8 Drawing Sheets

HOLDING DEVICE FOR USE IN A BATHROOM

BACKGROUND OF THE INVENTION

1. Field of the invention

The present invention relates to a bathroom tool holding device, more particularly one, which is used to hold bathroom tool such as plunger and toilet cleaning brush, and which consists of a hollow body with an opening, a bottom cover joined on a lower end of the body, a lid rotatably held in the body, and a pivotal shaft component positioned between the bottom cover and a lower side of the lid to allow smooth rotation of the lid.

2. Brief Description of the Prior Art

Toilet tools such as plungers and toilet brushes are usually placed near to the toilet bowl in a bathroom. However, it isn't hygienic to do so because the toilet tools will produce unpleasant odor if they aren't thoroughly washed and cleaned after use. Therefore, toilet holding devices are available for handling the above-mentioned problem.

Shown in FIG. 8 is a rotating toilet tool holder as taught in U.S. Pat. No. 7,185,759B2. The toilet tool holder consists of a base component 10, an inner shell 20, an outer shell 30, and four bearing assemblies 40. The shells 20 and 30 each have an opening. The base component 10 is joined on a lower end of the outer shell 30. The bearing assemblies 40 are installed on the upper side of the base component 10. The inner shell 20 is rotatably held in the outer shell 30, and supported on the bearing assemblies 40 so as to be capable of rotating to a closed position to shut the opening of the outer shell 30 to cover a toilet tool such as toilet brush and plunger held in the toilet tool holder. The inner shell 20 can be rotated to an open position to allow a toilet tool to be positioned in and taken out of the holder.

The above toilet tool holder has the following drawbacks:

1. It is possible for the four bearing assemblies to interfere with each other in rotation, and it turn the inner shell can't be smoothly rotated.

2. It is possible for apertures to exist between the base component and the inner shell as well as between the inner shell and the outer shell. Consequently, foul water, dirty substance, and harmful insects will gather in the apertures.

SUMMARY OF THE INVENTION

It is a main object of the present invention to provide an improvement on a bathroom tool holding device to overcome the above problems.

A bathroom tool holding device according to an embodiment of the present invention consists of a hollow body, a bearing member installed on the body to hold a toilet cleaning brush, a bottom cover joined on a bottom of the body, and a lid with a base. The hollow body has an opening. The bottom cover has a middle cavity, in which a pivotal shaft component is inserted. The lid is held in the body, and can be rotated to a closed position for a curved covering half part thereof to cover the opening of the body; the lid can be rotated to an open position so that a plunger can be placed in or taken out of the body. The base is pivoted on the pivotal shaft component for the lid to be smoothly rotated. Furthermore, the base is forced to come into close touch with the body with an elastic element, and in turn there is no aperture in between to contain foul water, dirty substance, and harmful insects.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
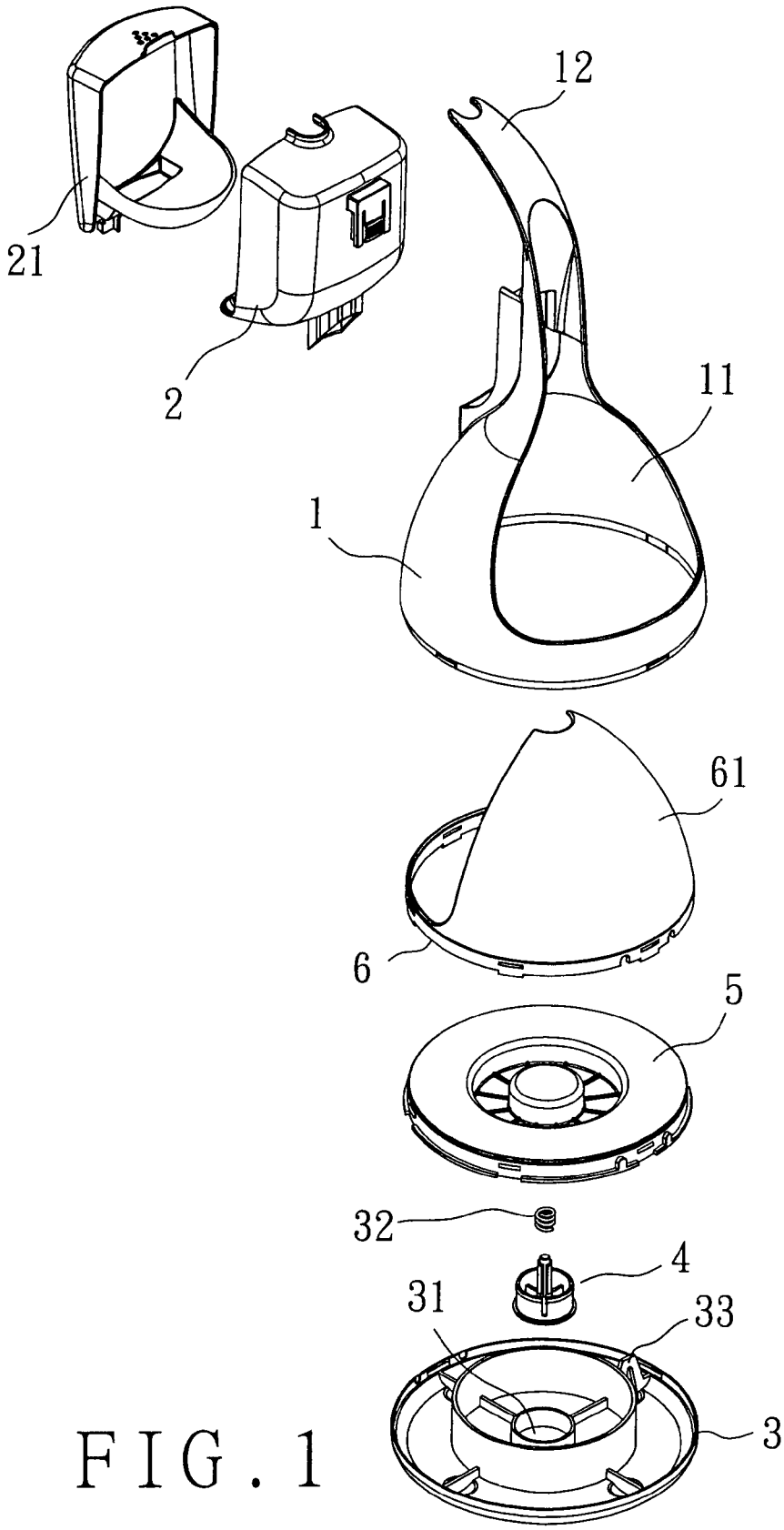
FIG. 1 is an exploded perspective view of the present invention.
Figure 2:
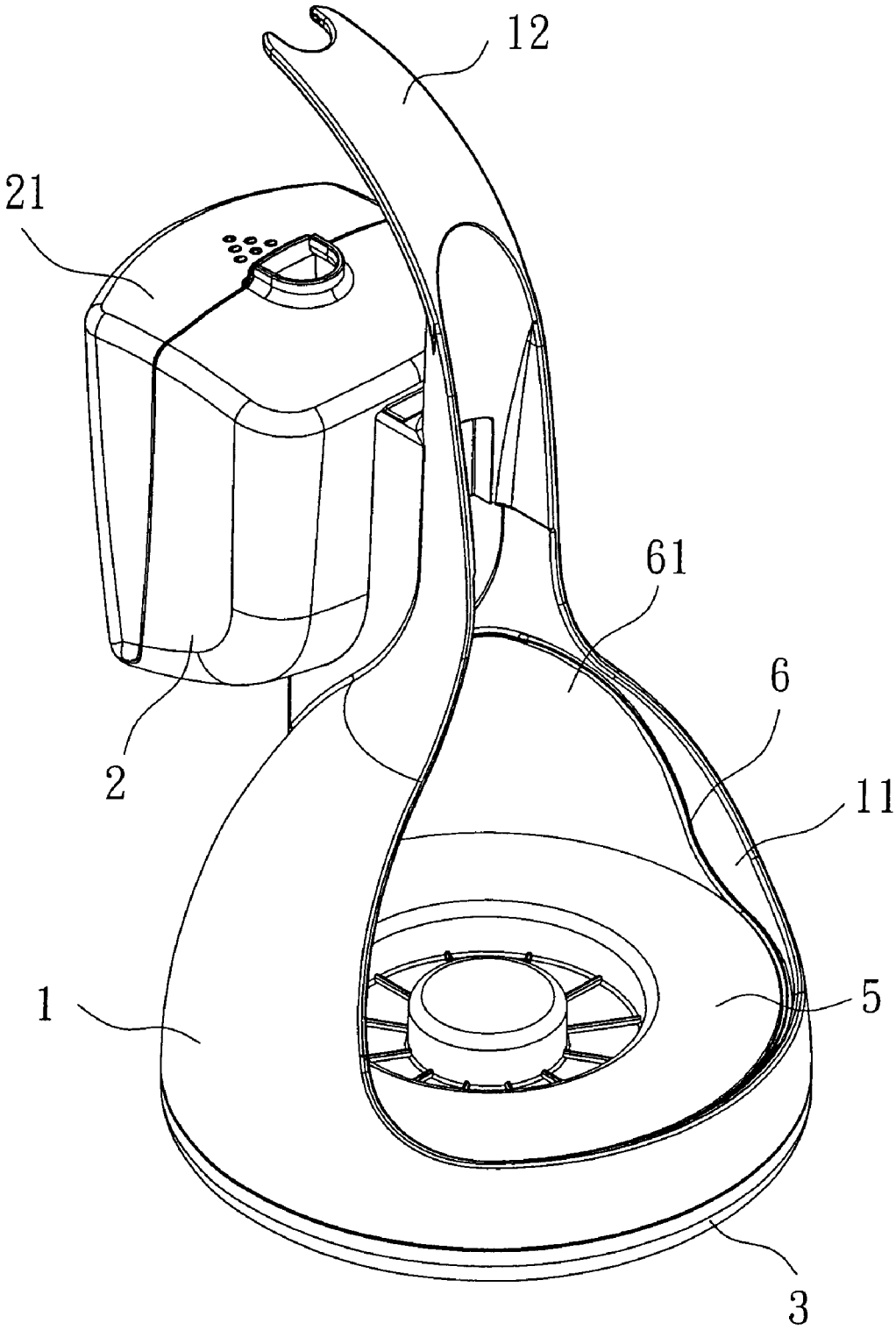
FIG. 2 is a perspective view of the present invention (1)
Figure 3:
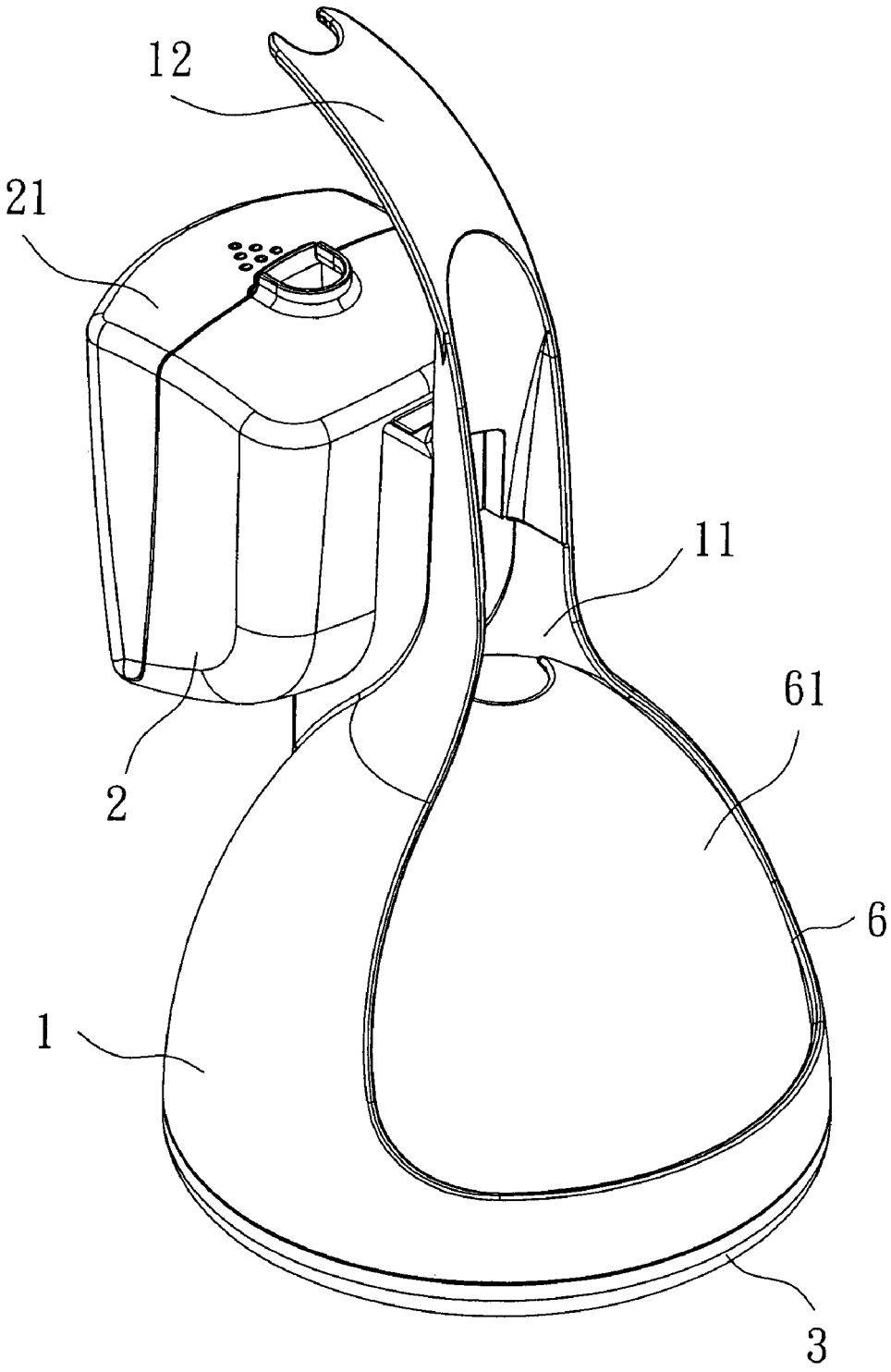
FIG. 3 is a perspective view of the present invention (2)
Figure 4:
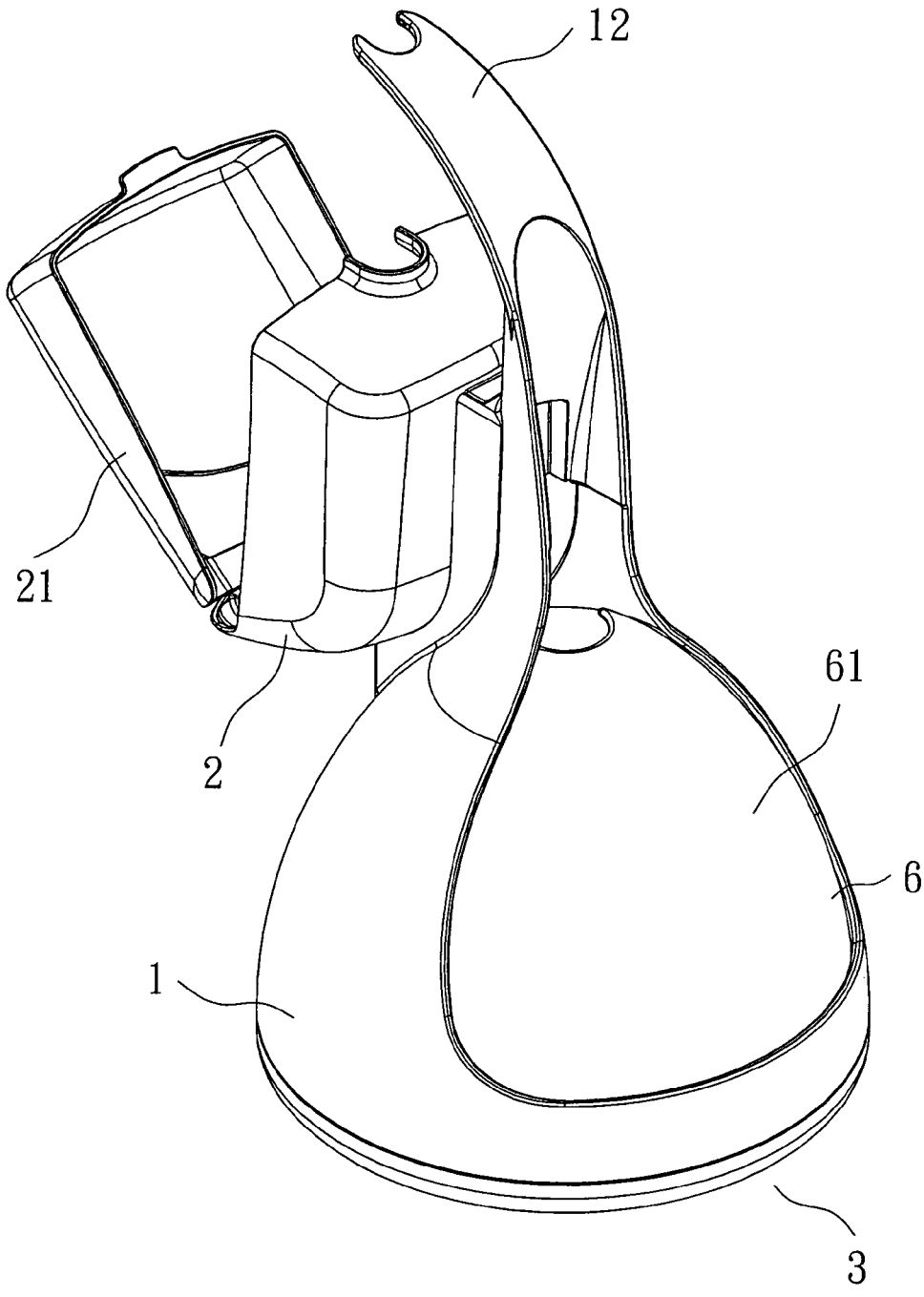
FIG. 4 is a perspective view of the present invention (3)

Referring to FIG. 1 to FIG. 3, and FIG. 6, a preferred embodiment of a bathroom tool holding device of the present invention consists of a body 1, a bearing member 2, a bottom cover 3, a pivotal shaft component 4, a lid 6, and a base 5 joined on a lower end of the lid 6.

The body 1 has a middle holding room 11 with an opening. The body 1 further has a fixing stem 12 protruding therefrom. The bearing member 2 is installed near to the fixing stem 12 on the body 1 to hold a toilet cleaning brush (B). The bearing member 2 has a covering 21 fitted thereon to cover the toilet cleaning brush (B).

The bottom cover 3 is joined to a lowermost part of the body 1, and has a cavity 31 on a middle portion thereof. The pivotal shaft component 4 is securely inserted in the cavity 31 of the bottom cover 3.

The lid 6 is rotatably held in the holding room 11 of the body 1, and has a curved covering half part 61 on one side. The base 5 is positioned on an upper side of the bottom cover 3, and joined to the lid 6 at a periphery thereof. The base 5 is pivoted on the pivotal shaft component 4. Therefore, the lid 6 can be rotated to a first closed position for the curved covering half part 61 to be over the opening of the holding room 11 of the body 1 so as to prohibit access to the holding room 11. And, the lid 6 can be rotated to a second open position to uncover the opening of the holding room 11 of the body 1 so as to provide access to the holding room 11; thus, a person is allowed to take a bathroom/toilet tool such as a toilet brush and a plunger from the holding device, and is allowed to put the bathroom tool into the holding device.

Figure 5:
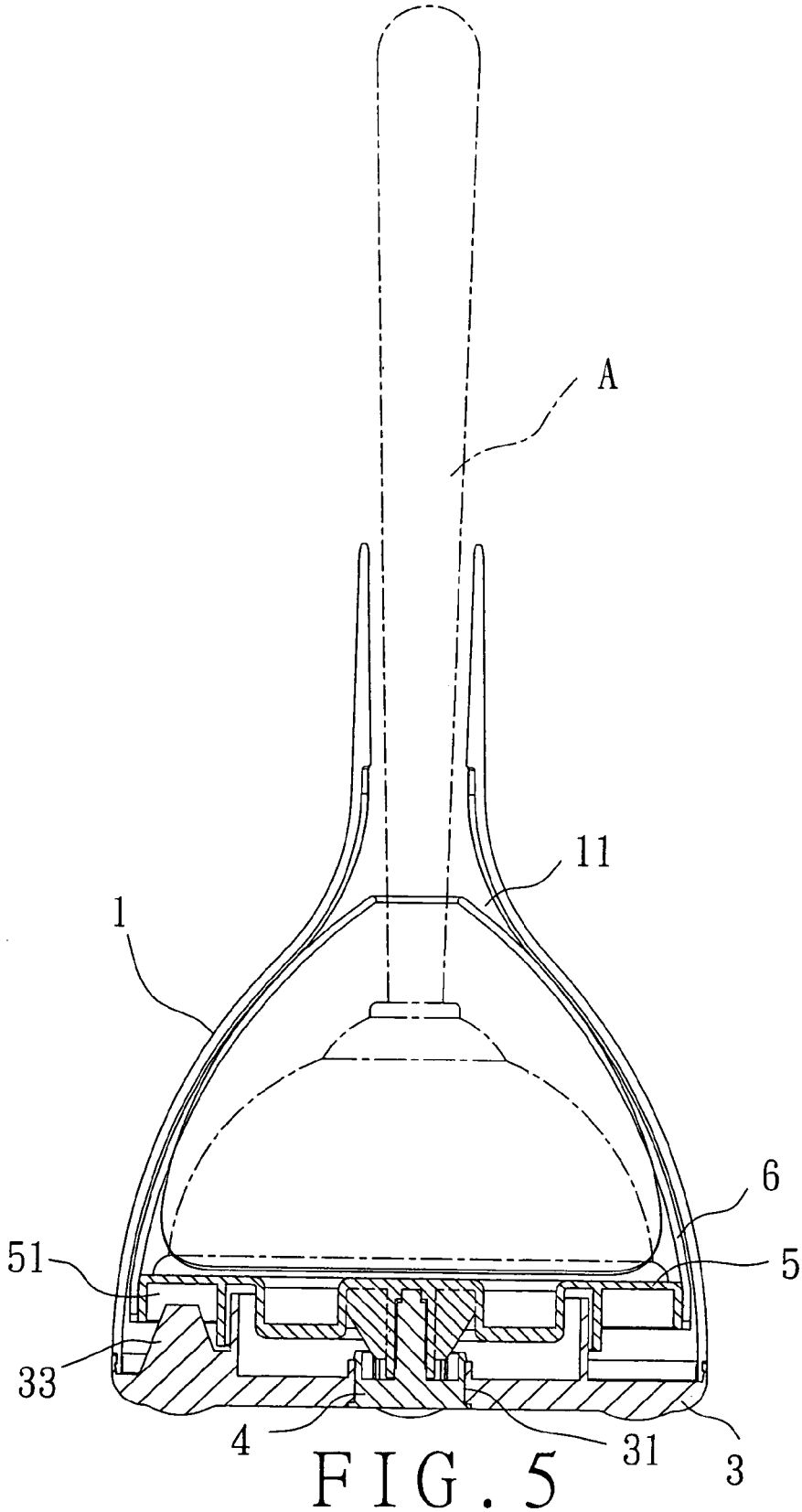
FIG. 5 is a sectional view of the present invention (1)
Figure 6:
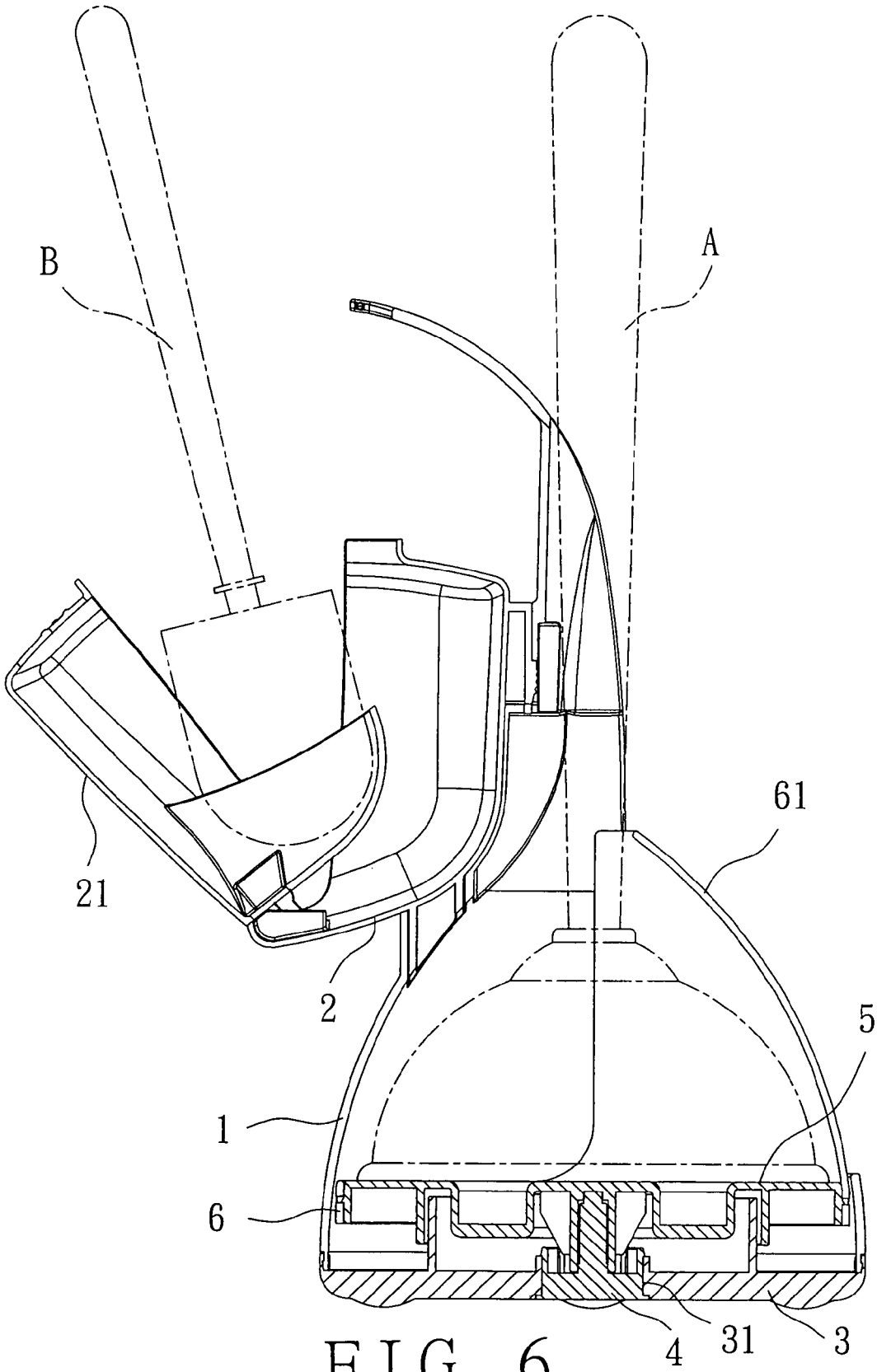
FIG. 6 is a sectional view of the present invention (2)
Figure 7:
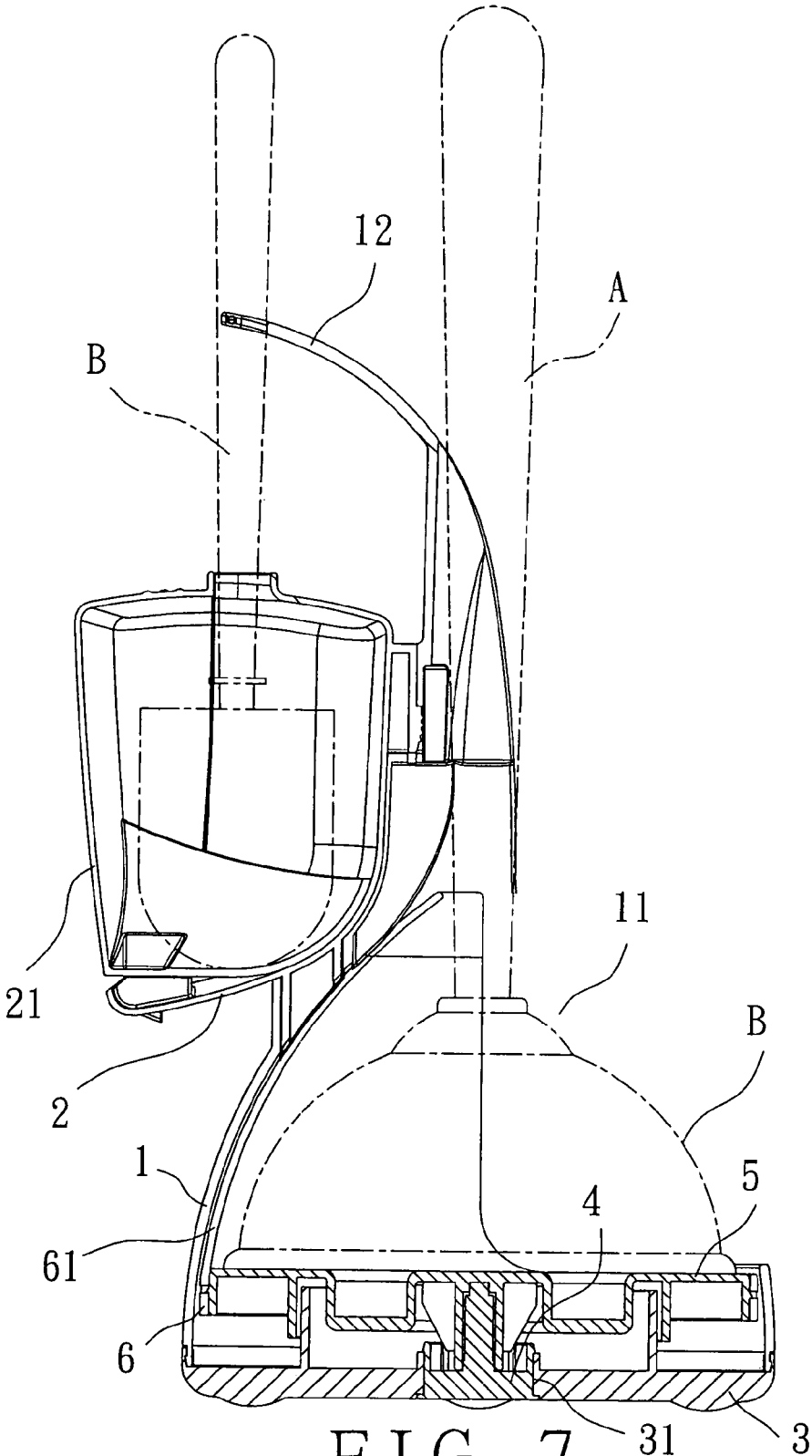
FIG. 7 is a sectional view of the present invention (3)
Figure 8:
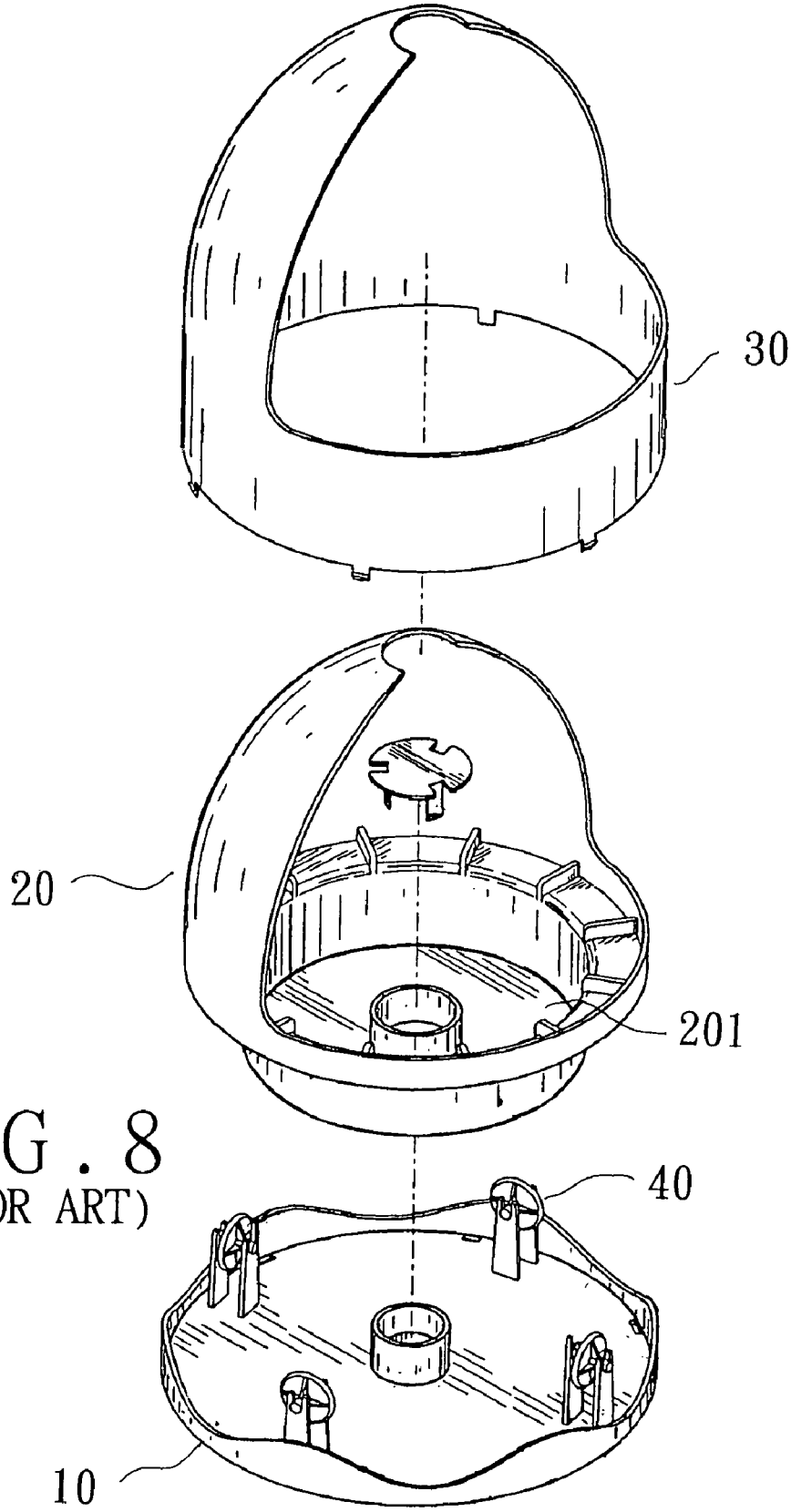
FIG. 8 (PRIOR ART)
FIG. 8 is an exploded perspective view of the prior art.

Furthermore, referring to FIGS. 1 and 5, the bottom cover 3 has a stopping plate 33 on a periphery thereof, and the base 5 has a plate part 51 protruding from on a bottom side thereof to cooperate with the stopping plate 33 of the bottom cover 3 so that the lid 6 can be stopped at a proper closed position, and can be stopped at a proper open position while it is being rotated on the pivotal shaft component 4.

Moreover, referring to FIG. 1 again, an elastic element 32 is positioned between the bottom cover 3 and the base 5 of the lid 6 to force the base 5 to come into close touch with the body 1; thus, there can't be any aperture on the joint between the base 5 and the body 1 to contain foul water, dirty substance, and harmful insects.

In assembly, referring to FIG. 3 to FIG. 7, first the pivotal shaft component 4 is inserted in the cavity 31 through the lower side of the bottom cover 3, and the lid 6 with the base 5 is positioned on the bottom cover 3 to be rotatable on the pivotal shaft component 4. Next, the body 1 is positioned around the lid 6, and joined on the bottom cover 3; thus, a plunger (A) can be held in the holding room 11 of the body 1, and supported on the base 5 of the lid 6 after the lid 6 has been turned to the open position; the lid 6 can be turned to the closed position for the curved covering half part 61 thereof to cover the holding room 11 of the body 1. And, the bearing member 2 is installed near to the fixing stem 12 on the body 1 so that a brush part of a toilet cleaning brush (B) can be held in the bearing member 2, and covered with the covering 21, and a handle of the toilet cleaning brush (B) can be propped against and fixed with the fixing stem 12 of the body 1.

From the above description, it can be seen that bathroom tool holding device of the present invention has the following advantages over the prior art:

1. The opening of the body can be completely covered with the lid to prevent bad odor from coming out from the holding device after a bathroom/toilet tool such as a plunger is positioned in the body.

2. The base of the lid is supported on the pivotal shaft component, which has a relatively simple structure, at the middle portion therefore the lid can be smoothly rotated between the open position and the closed one, and the holding device of the present invention is convenient to use.

3. The base of the lid is forced to come into close touch with the body by means of the elastic element between the bottom cover and the base. Therefore, there can't be any aperture on the joint between the base and the body to contain foul water, dirty substance, and harmful insects.

What is claimed is:

1. A freestanding holding device for use in a bathroom, comprising:

a body, the body having a fixing stem and a holding room, the holding room defining an opening formed within a body wall, the holding room providing a space holding a plunger;

a bearing member, the bearing member having a cover, the bearing member being disposed external to the body wall and removably coupled to the exterior of the body wall, the bearing member providing a chamber holding a toilet cleaning brush, the bearing member having an opening formed through a top surface thereof for extension therethrough of a handle of said toilet cleaning brush, said fixing stem having a notch formed within an end thereof receiving the handle of said toilet cleaning brush when said toilet cleaning brush is within said chamber of said bearing member and said bearing member cover is closed;

a bottom cover joined to a bottom of the body; the bottom cover having a circular cavity formed on a central portion of an upper surface thereof; the bottom cover having a stopping plate on a periphery thereof;

a pivotal shaft component securely inserted in the cavity of the bottom cover;

a lid rotatably held in the holding room of the body; the lid having a curved covering half part on one side; the lid being rotated to a first closed position for the curved covering half part thereof to cover the opening of the holding room of the body to prohibit access to the holding room; the lid being rotated to a second open position to uncover the opening of the holding room of the body to provide access to the holding room; and a base, positioned on the upper side of the bottom cover, and joined to the lid at a periphery thereof; the base being pivoted on the pivotal shaft component; the base having a plate part protruding from a bottom side to engage with the stopping plate.

2. The holding device for use in a bathroom as claimed in claim 1 further having an elastic element, which is positioned between the bottom cover and the base of the lid to force the base to come into close touch with the body.

* * * * *